United States Patent [19]

Waldock et al.

[11] Patent Number: 4,875,950

[45] Date of Patent: Oct. 24, 1989

[54] EXPLOSIVE COMPOSITION

[75] Inventors: Kevin H. Waldock, Mt Thorley; Daniel A. Wasson, Singleton, both of Australia

[73] Assignee: CBS Explosives Pty Limited, New South Wales, Australia

[21] Appl. No.: 204,370

[22] Filed: Jun. 9, 1988

[30] Foreign Application Priority Data

Jun. 10, 1987 [AU] Australia ..... PI2386
Nov. 18, 1987 [AU] Australia ..... PI5547

[51] Int. Cl.[4] ..... C06G 45/02

[52] U.S. Cl. ..... 149/21; 149/2; 149/43; 149/44; 149/46; 149/60; 149/61; 149/76

[58] Field of Search ..... 149/2, 21, 44, 43, 46, 149/60, 61, 76

[56] References Cited

U.S. PATENT DOCUMENTS

| | | | |
|---|---|---|---|
| 4,404,050 | 9/1983 | Yorke et al. | 149/2 |
| 4,420,349 | 12/1983 | Bampfield | 149/2 |
| 4,470,855 | 9/1984 | Bampfield | 149/2 |
| 4,735,232 | 3/1989 | Ciaramitaro | 149/2 |

*Primary Examiner*—Stephen J. Lechert, Jr.
*Attorney, Agent, or Firm*—Birch, Stewart, Kolasch & Birch

[57] ABSTRACT

This invention relates to a dry mix explosive composition which includes a bulking agent which comprises from 1–20% (by weight) of a vegetable protein additive, the bulking agent having a bulk density of 0.1–0.6 grams per cubic centimeter. It is preferred that the resulting explosive composition have a bulk density of from 0.5–1.1 grams per cubic centimeter.

17 Claims, No Drawings

EXPLOSIVE COMPOSITION

BACKGROUND OF THE INVENTION

THIS INVENTION relates to explosive compositions, and in particular to a dry mix explosive composition.

Explosives, including dry mix explosives, have been known for a number of years and have been relatively widely used. Such dry mix explosive compositions are all essentially different mixes of oxidizer and fuel.

In various formulations developed over the years, the oxidizer portion of the composition was essentially ammonium nitrate and thereafter other nitrate salts were added. Fuels such as a fuel sensitizer was often used and additional liquids such as other grades of fuel oil, alcohols, paraffin and nitrated paraffins have been added. In addition, other additives such as molecular explosives (for example TNT or smokeless powder) were also added. Combinations of different powdered fuels have been used to replace liquid fuels. Essentially however all the mixes have been relatively similar in that they are composite explosives being mixtures of oxidizer and fuel.

It is an object of this invention to provide an improved and efficient explosive composition.

Other objects of this invention will become apparent from the following description.

SUMMARY OF THE PRESENT INVENTION

According to the present invention there is provided a dry mix explosive composition including a bulking agent comprising from 1 to 20% (by weight) of a fibrous vegetable protein additive, the bulking agent having a bulk density of 0.1 to 0.6 grams per cubic centimeter producing an explosive composition having a bulk density of from 0.5–1.1 grams per cubic centimeter.

According to a further embodiment of the invention, there is provided a dry mix explosive composition, including oxidizer and fuel and further including bulking agent comprising from 1 to 20% (by weight) of a fibrous finely divided vegetable protein matter having a bulk density of 0.1 to 0.6 grams per cubic centimeter.

According to still further embodiment of the invention, there is provided a dry mix explosive composition, including oxidizer, fuel and a bulking agent comprising from 1 to 20 % (by weight) of a fibrous finely divided protein vegetable matter having a bulk density of 0.1 to 0.6 grams per cubic centimetre, and further including a binding or holding agent in the form of a waterin-oil emulsion.

DETAILED DESCRIPTION OF THE INVENTION

This invention will now be described by way of example only and it should be appreciated that modifications and improvements may be made to the invention without departing from the scope thereof, as defined by the claims appended hereto.

The present invention sets out to provide an improved and effective low density dry mix explosive composition.

It has been found that the explosive composition of the present, essentially utilizing a bulking agent which comprises fibrous vegetable protein matter, provides an improved and efficient explosive composition with a lower density.

Use of the explosive composition of the present invention, including the bulking agent, has shown that rock breakage on an equal weight basis is enhanced.

It has been found in particular that the explosive composition of the present invention allows for the parts thereof to be more evenly and regularly distributed over the area or length of the explosive charge. For example, if a miner is inserting explosive into a blast hole using known explosive compositions, the active parts of the composition are likely in many cases to be localized ( for example towards the bottom of the blast hole. This means that on detonation, there may be a relatively localized explosion in one particular area of the blast hole, rather than substantially along the entire length or area of the blast hole, which is more effective and advantageous. By using the explosive composition of the present invention, incorporating a bulking agent comprising fibrous vegetable protein matter, the parts of the composition are found to be more evenly distributed throughout the length or area of the composition and accordingly the length or area of the blast hole or area to be blasted, as a result of which there is a more equal distribution of detonation force.

It has been further found that by using the fibrous vegetable protein matter, in the bulking agent of the present invention, the fibrous nature of such vegetable matter assists in holding together the component parts of the composition and contributes towards resisting segregation, such as may be caused by wind, external forces, or during loading of blast holes and the like.

In a preferred form of the present invention, the explosive composition includes appropriate known or suitable oxidizer(s) and fuel(s), and also includes a bulking agent which is formed comprising from 1 to 20% (by weight) of a fibrous vegetable protein additive, the bulking agent having a bulk density of from 0.1 to 0.6 grams per cubic centimeter.

In a further form of the invention, the bulking agent comprises from 0.5 to 10% (by weight) lipids.

In a preferred form of the invention, the bulking agent includes up to 5% (by weight) of the fibrous vegetable protein content, the bulking agent having a bulk density of 0.2 grams per cubic centimeter.

PREFERRED EMBODIMENTS

By way of example only, we set out below various forms of the dry mix explosive composition according to the present invention, the various parts being stated by weight:

(1) Dry oxidizer salts, a carbonaceous liquid fuel and a finely divided protein containing bulking agent as the active constituents.

(2) The constituents as set out in (1) above in the ratios which will preclude detonation with a number 8 detonating cap.

(3) The constituents as set out in (2) above wherein the dry oxidizer salts comprise ammonium nitrate and other inorganic nitrate salts.

(4) The constituents as set out in (2) above wherein the carbonaceous fuel contains fuel oil (e.g. grade 2 distillate).

(5) The constituents as set out in (2) above wherein the dry oxidizer salts include ammonium perchlorate.

(6) The constituents as set out in (2) above wherein the finely divided protein containing bulking agent additive contains from 1 to 20% vegetable protein, 0.5 to 10% lipids and has a bulk density of 0.1 to 0.6 grams per cubic centimeter.

(7) The constituents as set out in (2) above wherein the dry oxidizer is ammonium nitrate and including a fuel sensitizer which is a mixture of powdered fuels and metals.

(8) The constituents as set out in (2) above wherein the dry oxidizer is ammonium nitrate porous prills, the fuel is grade 2 distillate, and the bulking agent is a chopped material containing vegetable protein.

Further, and by way of example only, several representative and preferred formulations of the present invention are now given and set out below, the percentages again being stated by weight:

| | Formulation numbers | | | | |
|---|---|---|---|---|---|
| Constituents | 1 | 2 | 3 | 4 | 5 |
| Ammonium Nitrate | 75 | 70 | 57 | 84 | 89 |
| Calcium Nitrate | — | 10 | — | — | — |
| Sodium Nitrate | — | 5 | — | — | — |
| Molecular explosive | — | — | 30 | — | — |
| Distillate grade 2 | 5 | 5 | 3 | 6 | 6 |
| Bulking Agent | 20 | 10 | 10 | 10 | 5 |

It should be noted that the preferred bulk densities of the mixtures referred to in the above formulations are, by way of example, from 0.5 to 1.1 grams per cubic centimeter.

It should be appreciated that any appropriate molecular explosive may be used, such as for example TNT Pelletol, smokeless powder, methyl amine nitrates, ethanol amine nitrate and and the like. Further, it should be appreciated that in some forms of the invention, the molecular explosive may be provided in a slurry form, such as mixed with a solvent, such as water. In one form of the invention, a molecular explosive, such as methyl amine nitrate, may be mixed with water up to about 10% (by weight) to form an explosive slurry.

In a further form of the present invention, a further additive is used in order to prevent or decrease segregation. It is always a problem with dry explosive compositions, that parts of the composition may separate, or be blown away during mixing, or in particular during loading into a blast hole. In particular, during loading into a blast hole, the parts of the composition may become segregated, the heavier parts reaching the bottom of the blast hole first. This segregation can result in irregular blasting or detonation, and it is always desirable to hold the parts of the composition together as much as possible, thus avoiding or at least minimizing the chances of segregation. Such segregation is often a problem with the use of explosives which are dry mixtures and it is considered that in one aspect, the present invention provides means whereby such segregation is at least reduced.

In the present invention, the dry mix explosive composition has further added to it a water-in-oil emulsion, which is mixed with the other parts of the explosive composition, the emulsion serving to bond and hold together the parts of the composition so as to avoid or minimize segregation.

Up until this time, it has been known to attempt to overcome or minimize segregation by the use of adhesive or bonding agents, however, these have been found to be particularly unsatisfactory especially during mixing, in that they stick to the mixing equipment, and are essentially unsatisfactory in use. It has however been found that by using a water-in-oil emulsion according to the present invention, the constituent parts of the explosive composition are held or bonded together such as to prevent or minimize segregation, while not adhering or sticking to each other in such a manner as would be the case if a known adhesive or glue was used.

The water-in-oil emulsion of the present invention preferably consists of a water-based solution of one or more oxidizer salts which are typically nitrates and/or perchlorates held in the disperse phase in oil by an emulsifier. Other oxidizer salts can however be used. Preferably the oil phase may typically be fuel oil, mineral oil, vegetable oil, paraffin, or any appropriate oil and/or wax material. It is however desirable that the oxidizer solution be emulsified and remain as a disperse phase.

By way of example, an explosive composition using the further additive of the prsent invention can include from 50% to 95% (by weight) dry oxidizer salts, up to 50% (by weight) bulking agent, including vegetable protein matter, and up to 60% (by weight) water-in-oil emulsion.

In preferred forms of the invention, the vegetable protein matter is a dry chopped vegetable protein matter containing less than 20% (by weight) water. In the preferred form of the invention, the vegetable protein matter may be in the form of legumes and, in particular, legumes in the form of nuts and nut shells, such as for example peanut shells and walnut shells. Such vegetable protein matter has been found to be particularly effective in use and have the desired properties for use as a bulking agent according to the present invention. It should be appreciated however, that other appropriate vegetable protein matter can be used to advantage.

It should be appreciated therefore, that in one form of the present invention, the use and addition of a water-in-oil emulsion serves to add a bonding or adhesion effect to the parts of the composition, without the usual sticky or undesirable effects of known glues or adhesives. The use of the emulsion serves to hold the parts of the composition together so as to avoid, reduce or minimize segregation as referred to above This invention has been described by way of example only and improvements and modifications may be made to the invention without departing from the scope and spirit thereof as defined by the appended claims.

We claim:

1. A dry mix explosive composition including a bulking agent, comprising from 1–20% (by weight) of a fibrous vegetable protein additive, said bulking agent having a bulk density of from 0.1–0.6 grams per cubic centimeter and said explosive composition having a bulk density of from 0.5–1.1 grams per cubic centimeter.

2. A dry mix explosive composition as in claim 1, further including a binding or holding agent in the form of a water-in-oil emulsion.

3. A dry mix explosive composition as in claim 1, further comprising an oxidizer and fuel.

4. A dry mix explosive composition as in claim 1, wherein said bulking agent comprises up to 5% (by weight) of said fibrous vegetable protein additive, said bulking agent having a bulk density of about 0.2 grams per cubic centimeter.

5. A dry mix explosive composition as in claim 1, wherein said bulking agent includes from 0.5–10% (by weight) lipids.

6. A dry mix explosive composition as in claim 1, further comprising dry oxidizer salts and carbonaceous liquid fuel.

7. A dry mix explosive composition as in claim 1, further including a dry oxidizer.

8. A dry mix explosive composition as in claim 7, wherein said dry oxidizer comprises dry oxidizer salts in the form of ammonium nitrate and said explosive composition further includes at least one additional inorganic nitrate salt.

9. A dry mix explosive composition as in claim 7, wherein said dry oxidizer comprises dry oxidizer salts including ammonium perchordate. said bulk density of from 0.1–0.6 grams per cubic centimeter.

10. A dry mix explosive composition as in claim 1, further comprising a carbonaceous fuel in the form of fuel oil.

11. A dry mix explosive composition as in claim 7, wherein said dry oxidizer is in the form of ammonium nitrate and said explosive composition further includes a fuel sensitizer as a mixture of powder fuel and metal.

12. A dry mix explosive composition as in claim 7, wherein said dry oxidizer is in the form of ammonium nitrate porous prills, and said explosive composition further includes a fuel in the form of fuel oil.

13. A dry mix explosive composition as in claim 1, comprising from 57%–89% (by weight) ammonium nitrate , from 0.0%–10% (by weight) calcium nitrate , from 0.0%–5% (by weight) sodium nitrate , from 0.0%–30% (by weight) of a molecular explosive , from 3%–6% (by weight) fuel oil and from 5%–20% (by weight) of said bulking agent 14. A dry mix explosive composition as in claim 1, wherein said bulking agent contains from 1% to 20% (by weight) of said fibrous vegetable protein and from 0.5% - 10% (by weight) lipids, said bulking agent having said bulk density of from 0.1–0.6 grams per cubic centimeter.

15. A dry mix explosive composition as in claim 1, further including a binding or holding agent in the form of a water-in-oil emulsion consisting of a water-based solution of one or more oxidizer salts held in a disperse phase of oil and/or wax.

16. A dry mix explosive composition as in claim 1, comprising 50%–95% (by weight) dry oxidizer salts , up to 50% (by weight) of said bulking agent including said fibrous vegetable protein additive and up to 60% (by weight) of a water-in-oil emulsion.

17. A dry mix explosive composition as in claim 1, wherein said fibrous vegetable protein additive contains less than 20% (by weight) water.

* * * * *